US010276143B2

(12) United States Patent
Prasad et al.

(10) Patent No.: US 10,276,143 B2
(45) Date of Patent: Apr. 30, 2019

(54) PREDICTIVE SOUNDSCAPE ADAPTATION

(71) Applicant: Plantronics, Inc., Santa Cruz, CA (US)

(72) Inventors: Vijendra G. R. Prasad, Cupertino, CA (US); Beau Wilder, Santa Cruz, CA (US); Evan Harris Benway, Santa Cruz, CA (US); Philip Sherburne, Morgan Hill, CA (US)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 15/710,435

(22) Filed: Sep. 20, 2017

(65) Prior Publication Data

US 2019/0088243 A1 Mar. 21, 2019

(51) Int. Cl.

| | |
|---|---|
| ***G10K 11/175*** | (2006.01) |
| ***H04R 29/00*** | (2006.01) |
| ***H04R 3/12*** | (2006.01) |
| ***H04R 1/40*** | (2006.01) |
| ***H04R 3/00*** | (2006.01) |
| ***G10L 21/0232*** | (2013.01) |

(52) U.S. Cl.

CPC ..... *G10K 11/175* (2013.01); *G10L 21/0232* (2013.01); *H04R 1/403* (2013.01); *H04R 1/406* (2013.01); *H04R 3/005* (2013.01); *H04R 3/12* (2013.01); *H04R 29/002* (2013.01)

(58) Field of Classification Search

CPC ..... G10K 11/175; G10L 21/0232; H04R 29/002; H04R 1/403; H04R 1/406; H04R 3/005; H04R 3/12

USPC ..... 381/56, 57, 58, 83, 94.1, 71.1, 105, 124

See application file for complete search history.

(56) References Cited

U.S. PATENT DOCUMENTS

| | | | | |
|---|---|---|---|---|
| 9,214,078 | B1 * | 12/2015 | Seese | G08B 21/0484 |
| 2005/0031141 | A1 * | 2/2005 | McCrackin | G10K 11/175 381/104 |
| 2009/0074199 | A1 * | 3/2009 | Kierstein | G10K 11/175 381/71.6 |
| 2010/0215165 | A1 * | 8/2010 | Smaak | H04R 27/00 379/202.01 |
| 2015/0131808 | A1 * | 5/2015 | Lennstrom | G10K 11/175 381/73.1 |
| 2015/0222989 | A1 | 8/2015 | Labrosse et al. | |
| 2016/0196818 | A1 * | 7/2016 | Christoph | H04S 7/301 381/71.6 |
| 2016/0265206 | A1 * | 9/2016 | White | G10K 11/178 |
| 2017/0193704 | A1 * | 7/2017 | Leppanen | G06F 3/1454 |
| 2017/0352342 | A1 * | 12/2017 | Lee | H04R 3/04 |
| 2018/0046156 | A1 * | 2/2018 | Gary, Jr. | G05B 15/02 |

* cited by examiner

*Primary Examiner* — William A Jerez Lora

(74) *Attorney, Agent, or Firm* — Chuang Intellectual Property Law

(57) ABSTRACT

Methods and apparatuses for addressing open space noise are disclosed. In one example, a method for masking open space noise includes receiving a sensor data from a sensor arranged to monitor an open space over a time period. The method includes generating a predicted future noise parameter in the open space at a predicted future time from the sensor data. The method further includes adjusting a sound masking noise output from a loudspeaker prior to the predicted future time responsive to the predicted future noise parameter.

27 Claims, 11 Drawing Sheets

Distraction Incident Data 400

| 402 Distraction | 404 Date | 406 Time | 408 Microphone Identifier | 410 Noise Level (dB) | 412 Location |
|---|---|---|---|---|---|
| Distraction 1 | Date 1 | T1 | Unique ID 1 | Noise Level 1 | Location 1 |
| Distraction 2 | Date 2 | T2 | Unique ID 1 | Noise Level 2 | Location 1 |
| Distraction 3 | Date 3 | T3 | Unique ID 2 | Noise Level 3 | Location 3 |
| Distraction 4 | Date 4 | T4 | Unique ID 3 | Noise Level 4 | Location 4 |
| . | . | . | . | . | . |
| . | . | . | . | . | . |

FIG. 4

Data Record 500

| | | | |
|---|---|---|---|
| Microphone Unique ID 1 (502) | | | |
| Location 1 (504) | | | |
| Date 506 | Time 508 | Predicted Noise Level(dB) (510) | Actual Noise Level (dB) (512) |
| Date 1 | Time 1 | PNL 1 | ANL 1 |
| Date 2 | Time 2 | PNL 2 | ANL 2 |
| Date 3 | Time 3 | PNL 3 | ANL 3 |
| Date 4 | Time 4 | PNL 4 | ANL 4 |
| . | . | . | . |
| . | . | . | . |

FIG. 5

PREDICTIVE SOUNDSCAPE ADAPTATION

BACKGROUND OF THE INVENTION

Noise within an open space is problematic for people working within the open space. Open space noise is typically described by workers as unpleasant and uncomfortable. Speech noise, printer noise, telephone ringer noise, and other distracting sounds increase discomfort. This discomfort can be measured using subjective questionnaires as well as objective measures, such as cortisol levels.

For example, many office buildings utilize a large open office area in which many employees work in cubicles with low cubicle walls or at workstations without any acoustical barriers. Open space noise, and in particular speech noise, is the top complaint of office workers about their offices. One reason for this is that speech enters readily into the brain's working memory and is therefore highly distracting. Even speech at very low levels can be highly distracting when ambient noise levels are low (as in the case of someone having a conversation in a library). Productivity losses due to speech noise have been shown in peer-reviewed laboratory studies to be as high as 41%.

Another major issue with open offices relates to speech privacy. Workers in open offices often feel that their telephone calls or in-person conversations can be overheard. Speech privacy correlates directly to intelligibility. Lack of speech privacy creates measurable increases in stress and dissatisfaction among workers.

In the prior art, noise-absorbing ceiling tiles, carpeting, screens, and furniture have been used to decrease office noise levels. Reducing the noise levels does not, however, directly solve the problems associated with the intelligibility of speech. Speech intelligibility can be unaffected, or even increased, by these noise reduction measures. As office densification accelerates, problems caused by open space noise become accentuated.

As a result, improved methods and apparatuses for addressing open space noise are needed.

BRIEF DESCRIPTION OF THE DRAWINGS

The present invention will be readily understood by the following detailed description in conjunction with the accompanying drawings, wherein like reference numerals designate like structural elements.

FIG. 4 illustrates distraction incident data in one example.

FIG. 5 illustrates a microphone data record in one example.

DESCRIPTION OF SPECIFIC EMBODIMENTS

Figure 1:
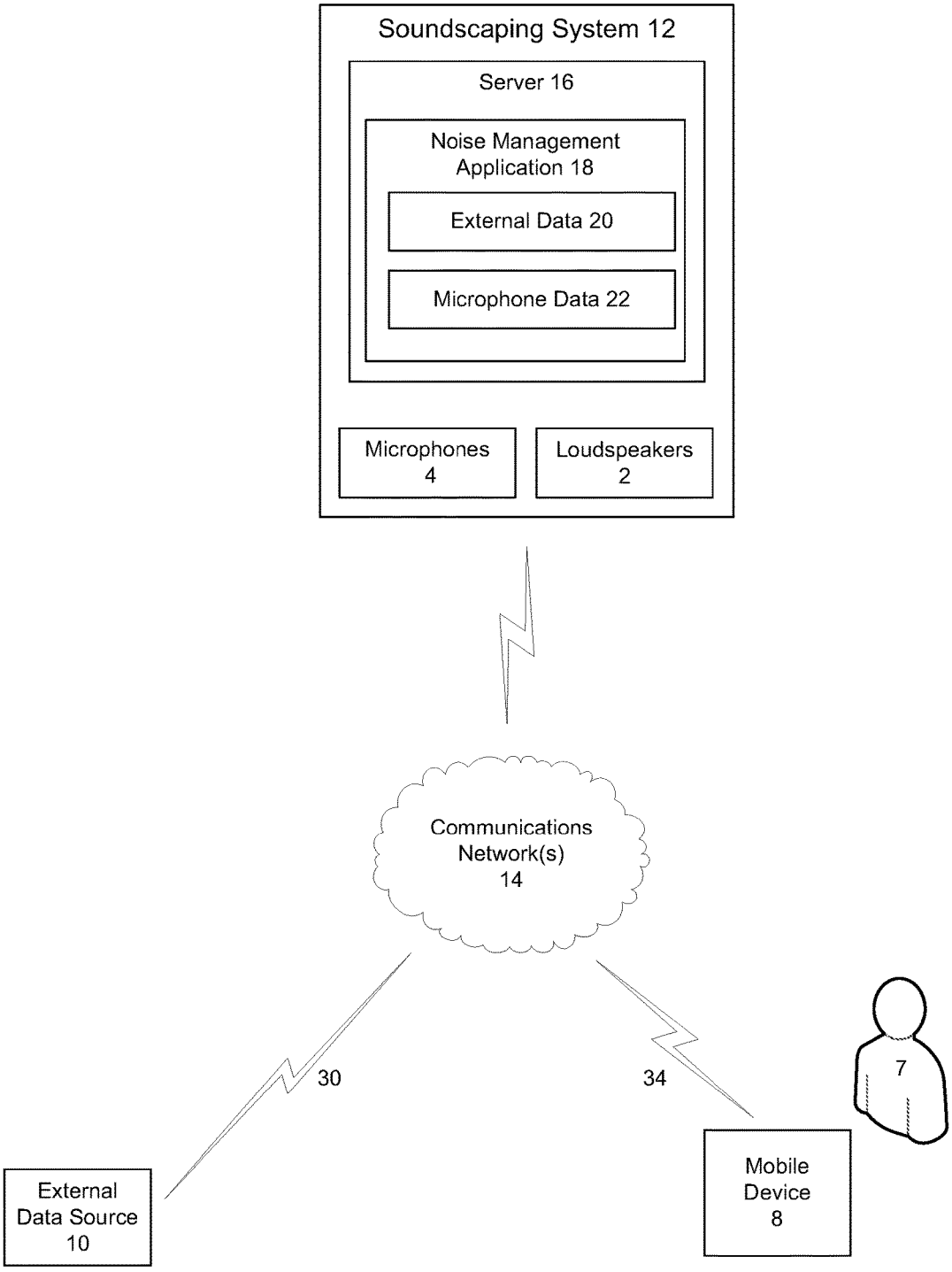
FIG. 1 illustrates a system for sound masking in one example.

Methods and apparatuses for masking open space noise are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein.

Block diagrams of example systems are illustrated and described for purposes of explanation. The functionality that is described as being performed by a single system component may be performed by multiple components. Similarly, a single component may be configured to perform functionality that is described as being performed by multiple components. For purpose of clarity, details relating to technical material that is known in the technical fields related to the invention have not been described in detail so as not to unnecessarily obscure the present invention. It is to be understood that various examples of the invention, although different, are not necessarily mutually exclusive. Thus, a particular feature, characteristic, or structure described in one example embodiment may be included within other embodiments.

"Sound masking" is the introduction of constant background noise in a space in order to reduce speech intelligibility, increase speech privacy, and increase acoustical comfort. For example, a pink noise, filtered pink noise, brown noise, or other similar noise (herein referred to simply as "pink noise") may be injected into the open office. Pink noise is effective in reducing speech intelligibility, increasing speech privacy, and increasing acoustical comfort.

The inventors have recognized one problem in designing an optimal sound masking system is setting the proper masking levels and spectra. For example, office noise levels fluctuate over time and by location, and different masking levels and spectra may be required for different areas. For this reason, attempting to set the masking levels based on educated guesses tends be tedious, inaccurate, and unmaintainable.

In one example of the invention, a method includes receiving a sensor data from a sensor arranged to monitor an open space over a time period. The method includes generating a predicted future noise parameter in the open space at a predicted future time from the sensor data. The method further includes adjusting a sound masking noise output from a loudspeaker prior to the predicted future time responsive to the predicted future noise parameter.

In one example, a method includes receiving a microphone data from a microphone arranged to detect sound in an open space over a time period. The method includes generating a predicted future noise parameter in the open space at a predicted future time from the microphone data. The method further includes adjusting a sound masking noise output from a loudspeaker prior to the predicted future time responsive to the predicted future noise parameter.

In one example, a method includes receiving a microphone output data from a microphone over a time period, and tracking a noise level over the time period from the microphone output data. The method further includes receiving an external data independent from the microphone output data. The method includes generating a predicted future noise level at a predicted future time from the noise level monitored over the time period or the external data. The method further includes adjusting a volume of a sound masking noise output from a loudspeaker prior to the predicted future time responsive to the predicted future noise level.

In one example, a system includes a plurality of microphones to be disposed in an open space and a plurality of loudspeakers to be disposed in the open space. The system includes one or more computing devices. The one or more computing devices include one or more communication interfaces configured to receive a plurality of microphone data from the plurality of microphones and configured to transmit sound masking noise for output at the plurality of loudspeakers. The one or more computing devices include a processor, and one or more memories storing one or more application programs includes instructions executable by the processor to perform operations. The performed operations include receiving a microphone data from a microphone arranged to detect sound in an open space over a time period, the microphone one of the plurality of microphones. The operations include generating a predicted future noise parameter in the open space at a predicted future time from the microphone data. The operations further include adjusting a sound masking noise output from a loudspeaker prior to the predicted future time responsive to the predicted future noise parameter, the loudspeaker one of the plurality of loudspeakers.

Advantageously, in the methods and systems described herein the burden of having to manually configure and manage complicated sound masking noise level schedules is removed. Machine learning techniques are implemented to automatically learn complex occupancy/distraction patterns over time, which allows the soundscape system to proactively modify the sound masking noise over larger value ranges to subtly reach the target for optimum occupant comfort. For example, the soundscape system learns that the distraction decreases or increases at a particular time of the day or a particular day of the week, due to meeting schedules. In a further example, the soundscape system learns that more female or male voices are present in a space at a particular time, so the sound masking noise characteristics are proactively changed to reach the target in subtle manner. Value may be maximized by combining data from multiple sources. These sources may range from weather, traffic and holiday schedules to data from other devices and sensors in the open space.

The described methods and systems offer several advantages. In one example, the soundscape system adjusts sound masking noise volume based on both predicted noise levels and real-time sensing of noise levels. This advantageously allows for the sound masking noise volume to be adjusted over a greater range of values than the use of only real-time sensing. Although an adaptive soundscape can be realized merely through real time sensing alone, the inventors have recognized such purely reactive adaptations are limited to a volume change of a relatively small range of values. Otherwise, the adaption itself may become a source of distraction to the occupants of the space. However, the range may be increased if the adaptation occurs gradually over a longer duration. The use of the predicted noise level as described herein allows the adaptation to occur gradually over a longer duration, thereby enabling a greater range of adjustment. Synergistically, the use of real-time sensing increases the accuracy of the soundscape system in providing an optimized sound masking level by identifying and correcting for inaccuracies in the predicted noise levels.

Advantageously, the described methods and systems identify complex distraction patterns within an open space based on historical monitored localized data. Using these complex distraction patterns, the soundscape system is enabled to proactively provide a localized response within the open space. In one example, accuracy is increased through the use of continuous monitoring, whereby the historical data utilized is continuously updated to account for changing distraction patterns over time.

FIG. 1 illustrates a system for sound masking in one example. The system includes a soundscaping system 12, which includes a server 16, microphones 4 (i.e., sound sensors), and loudspeakers 2. The system also includes an external data source 10 and a mobile device 8 in proximity to a user 7 capable of communications with soundscaping system 12 via one or more communication network(s) 14. Communication network(s) 14 may include an Internet Protocol (IP) network, cellular communications network, public switched telephone network, IEEE 802.11 wireless network, Bluetooth network, or any combination thereof.

Mobile device 8 may, for example, be any mobile computing device, including without limitation a mobile phone, laptop, PDA, headset, tablet computer, or smartphone. In a further example, mobile device 8 may be any device worn on a user body, including a bracelet, wristwatch, etc. Mobile device 8 is capable of communication with server 16 via communication network(s) 14 over network connection 34. Mobile device 8 transmits external data 20 to server 16.

Network connection 34 may be a wired connection or wireless connection. In one example, network connection 34 is a wired or wireless connection to the Internet to access server 16. For example, mobile device 8 includes a wireless transceiver to connect to an IP network via a wireless Access Point utilizing an IEEE 802.11 communications protocol. In one example, network connection 34 is a wireless cellular communications link. Similarly, external data source 10 is capable of communications with server 16 via communication network(s) 14 over network connection 30. External data source 10 transmits external data 20 to server 16.

Server 16 includes a noise management application 18 which interfaces with microphones 4 to receive microphone data 22. Noise management application 18 also interfaces with one or more mobile devices 8 and external data sources 10 to receive external data 20.

External data 20 includes any data received from a mobile device 8 or an external data source 10. External data source 10 may, for example, be a website server, mobile device, or other computing device. The external data 20 may be any type of data, and includes data from weather, traffic, and calendar sources. External data 20 may be sensor data from sensors at mobile device 8 or external data source 10. Server 16 stores external data 20 received from mobile devices 8 and external data sources 10.

The microphone data 22 may be any data which can be derived from processing sound detected at a microphone. For example, the microphone data 22 may include noise level measurements, frequency distribution data, or voice activity detection data determined from sound detected at the one or more microphones 4. Furthermore, in addition to or in alternative to, the microphone data 22 may include the sound itself (e.g., a stream of digital audio data).

Figure 2:
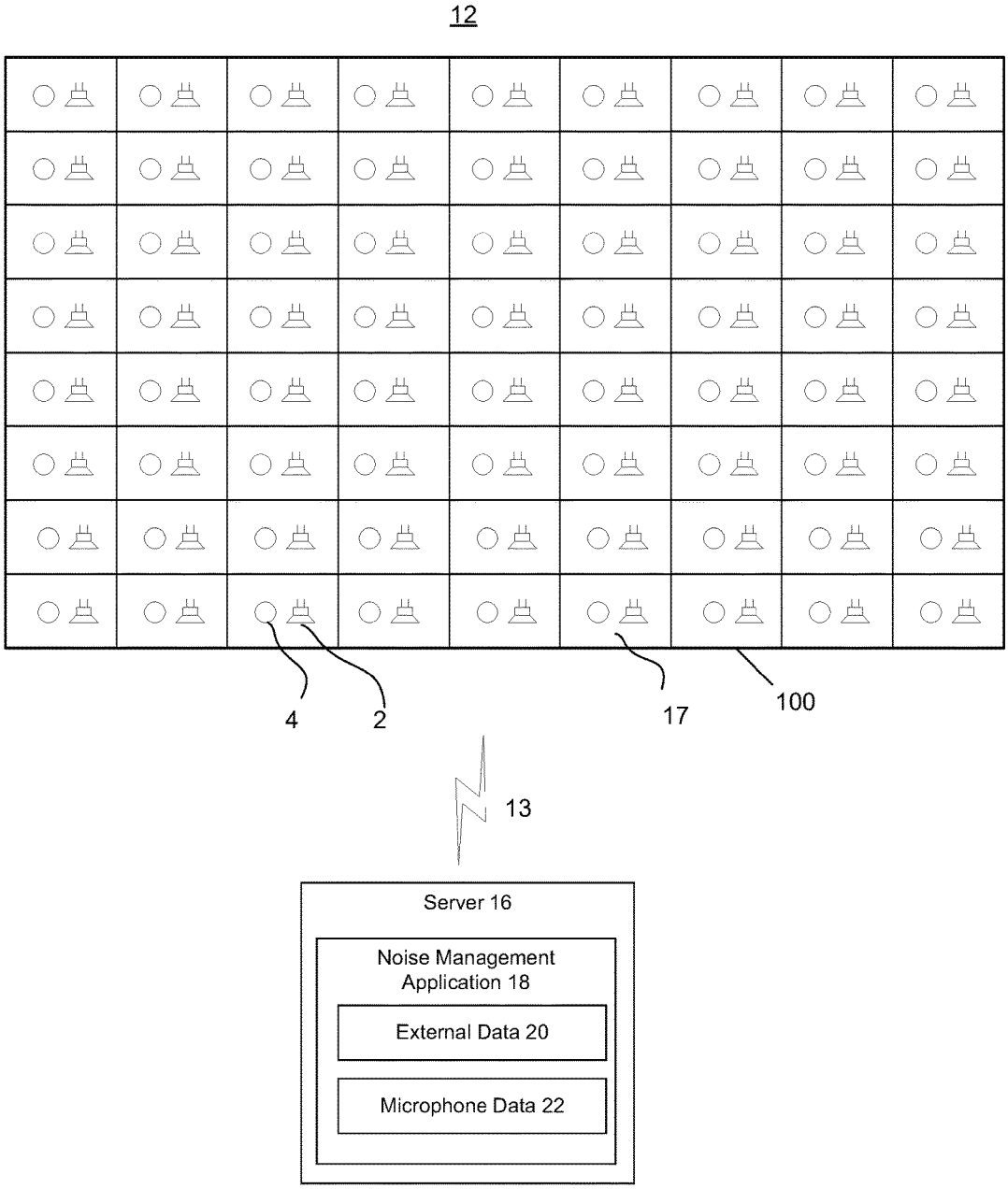
FIG. 2 illustrates an example of the soundscaping system shown in FIG. 1.

FIG. 2 illustrates an example of the soundscaping system 12 shown in FIG. 1. Placement of a plurality of loudspeakers 2 and microphones 4 in an open space 100 in one example is shown. For example, open space 100 may be a large room of an office building in which employee workstations such as cubicles are placed. Illustrated in FIG. 2, there is one loudspeaker 2 for each microphone 4 located in a same geographic sub-unit 17. In further examples, the ratio of loudspeakers 2 to microphones 4 may be varied. For example, there may be four loudspeakers 2 for each microphone 4.

Sound masking systems may be in-plenum or direct field. In-plenum systems involve loudspeakers installed above the ceiling tiles and below the ceiling deck. The loudspeakers are generally oriented upwards, so that the masking sound reflects off of the ceiling deck, becoming diffuse. This makes it more difficult for workers to identify the source of the masking sound and thereby makes the sound less noticeable. In one example, each loudspeaker 2 is one of a plurality of loudspeakers which are disposed in a plenum above the open space and arranged to direct the loudspeaker sound in a direction opposite the open space. Microphones 4 are arranged in the ceiling to detect sound in the open space. In a further example, a direct field system is used, whereby the masking sound travels directly from the loudspeakers to a listener without interacting with any reflecting or transmitting feature.

In a further example, loudspeakers 2 and microphones 4 are disposed in workstation furniture located within open space 100. In one example, the loudspeakers 2 may be advantageously disposed in cubicle wall panels so that they are unobtrusive. The loudspeakers may be planar (i.e., flat panel) loudspeakers in this example to output a highly diffuse sound masking noise. Microphones 4 may be also be disposed in the cubicle wall panels, or located on head-worn devices such as telecommunications headsets within the area of each workstation. In further examples, microphones 4 and loudspeakers 2 may also be located on personal computers, smartphones, or tablet computers located within the area of each workstation.

Sound is output from loudspeakers 2 corresponding to a sound masking signal configured to mask open space noise. In one example, the sound masking signal is a random noise such as pink noise. The pink noise operates to mask open space noise heard by a person in open space 100. In a further example, the sound masking noise is a natural sound such as flowing water.

Figure 10:
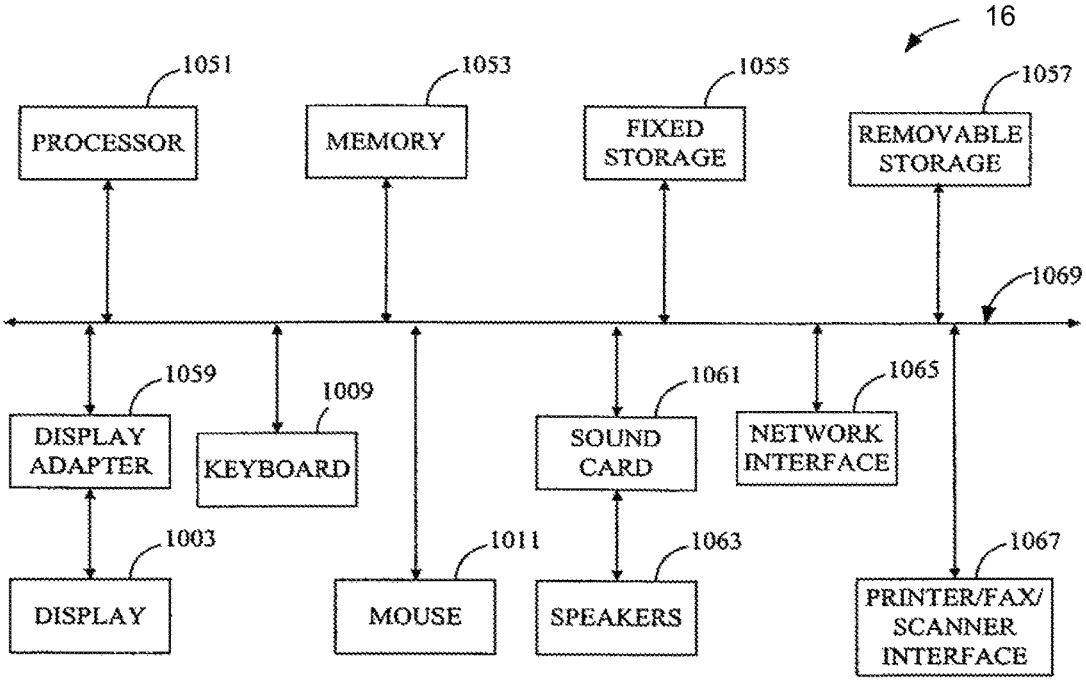
FIG. 10 illustrates a system block diagram of a server suitable for executing software application programs that implement the methods and processes described herein in one example.

The server 16 includes a processor and a memory storing application programs comprising instructions executable by the processor to perform operations as described herein, including receiving and processing microphone data and outputting sound masking noise. FIG. 10 illustrates a system block diagram of a server 16 in one example. Server 16 can be implemented at a personal computer, or in further examples, functions can be distributed across both a server device and a personal computer. For example, a personal computer may control the output at loudspeakers 2 responsive to instructions received from a server.

Server 16 is capable of electronic communications with each loudspeaker 2 and microphone 4 via either a wired or wireless communications link 13. For example, server 16, loudspeakers 2, and microphones 4 are connected via one or more communications networks such as a local area network (LAN) or an Internet Protocol network. In a further example, a separate computing device may be provided for each loudspeaker 2 and microphone 4 pair.

In one example, each loudspeaker 2 and microphone 4 is network addressable and has a unique Internet Protocol address for individual control (e.g., by server 16). Loudspeaker 2 and microphone 4 may include a processor operably coupled to a network interface, output transducer, memory, amplifier, and power source. Loudspeaker 2 and microphones 4 also include a wireless interface utilized to link with a control device such as server 16. In one example, the wireless interface is a Bluetooth or IEEE 802.11 transceiver. The processor allows for processing data, including receiving microphone signals and managing sound masking signals over the network interface, and may include a variety of processors (e.g., digital signal processors), with conventional CPUs being applicable.

Server 16 includes a noise management application 18 interfacing with each microphone 4 to receive microphone output signals (e.g., microphone data 22.) Microphone output signals may be processed at each microphone 4, at server 16, or at both. Each microphone 4 transmits data to server 16. Similarly, noise management application 18 receives external data 20 from mobile device 8 and/or external data source 10. External data 20 may be processed at each mobile device 8, external data source 10, server 16, or all.

The noise management application 18 receives a location data associated with each microphone 4 and loudspeaker 2. In one example, each microphone 4 location and speaker 2 location within open space 100, and a correlated microphone 4 and loudspeaker 2 pair located within the same sub-unit 17, is recorded during an installation process of the server 16. As such, each correlated microphone 4 and loudspeaker 2 pair allows for independent prediction of noise levels and output control of sound masking noise at each sub-unit 17. Advantageously, this allows for localized control of the ramping of the sound masking noise levels to provide high accuracy in responding to predicted distraction incidents while minimizing unnecessary discomfort to others in the open space 100 peripheral or remote from the distraction location. For example, a sound masking noise level gradient may be utilized as the distance from a predicted distraction increases.

In one example, noise management application 18 stores microphone data 22 and external data 20 in one or more data structures, such as a table. Microphone data may include unique identifiers for each microphone, measured noise levels or other microphone output data, and microphone location. For each microphone, the output data (e.g., measured noise level) is recorded for use by noise management application 18 as described herein. External data 20 may be stored together with microphone data 22 in a single structure (e.g., a database) or stored in separate structures.

The use of a plurality of microphones 4 throughout the open space ensures complete coverage of the entire open space. Utilizing this data, noise management application 18 detects the presence and locations of noise sources from the microphone output signals. Where the noise source is undesirable user speech, a voice activity is detected. For example, a voice activity detector (VAD) may be utilized in processing the microphone output signals. A loudness level of the noise source is determined. Other data may also be derived from the microphone output signals. In one example, a signal-to-noise ratio from the microphone output signal is identified.

Noise management application 18 generates a predicted future noise parameter (e.g., a future noise level) at a predicted future time from the microphone data 22 and/or from external data 20. Noise management application 18 adjusts the sound masking noise output (e.g., a volume level of the sound masking noise) from the soundscaping system 12 (e.g., at one or more of the loudspeakers 2) prior to the predicted future time responsive to the predicted future noise level.

From microphone data 22, noise management application 18 identifies noise incidents (also referred to herein as "distraction incidents" or "distraction events") detected by each microphone 4. For example, noise management application 18 tracks the noise level measured by each microphone 4 and identifies a distraction incident if the measured noise level exceeds a predetermined threshold level. In a further example, a distraction incident is identified if voice activity is detected or voice activity duration exceeds a threshold time. In one example, each identified distraction incident is labeled with attributes, including for example: (1) Date, (2) Time of Day (TOD), (3) Day of Week (DOW), (4) Sensor ID, (5) Space ID, and (6) Workday Flag (i.e., indication if DOW is a working day).

FIG. 4 illustrates distraction incident data 400 in one example. Distraction incident data 400 may be stored in a table including the distraction incident identifier 402, date 404, time 406, microphone unique identifier 408, noise level 410, and location 412. In addition to measured noise levels 410, any gathered or measured parameter derived from the microphone output data may be stored. Data in one or more data fields in the table may be obtained using a database and lookup mechanism. For example, the location 412 may be identified by lookup using microphone identifier 408.

Noise management application 18 utilizes the data shown in FIG. 4 to generate the predicted future noise level at a given microphone 4. For example, noise management application 18 identifies a distraction pattern from two or more distraction incidents. As previously discussed, noise management application 18 adjusts the sound masking noise level at one or more of the loudspeakers 2 prior to the predicted future time responsive to the predicted future noise level. In further examples, adjusting the sound masking noise output may include adjusting the sound masking noise type or frequency.

The output level at a given loudspeaker 2 is based on the predicted noise level from the correlated microphone 4 data located in the same geographic sub-unit 17 of the open space 100. Masking levels are adjusted on a loudspeaker-by-loudspeaker basis in order to address location-specific noise levels. Differences in the noise transmission quality at particular areas within open space 100 are accounted for when determining output levels of the sound masking signals.

In one example, the sound masking noise level is ramped up or down at a configured ramp rate from a current volume level to reach a pre-determined target volume level at the predicted future time. For example, the target volume level for a predicted noise level may be determined empirically based on effectiveness and listener comfort. Based on the current volume level and ramp rate, noise management application 18 determines the necessary time (i.e., in advance of the predicted future time) at which to begin ramping of the volume level in order to achieve the target volume level at the predicted future time. In one non-limiting example, the ramp rate is configured to fall between 0.01 dB/sec and 3 dB/sec. The above process is repeated at each geographic sub-unit 17.

At the predicted future time, noise management application 18 receives a microphone data 22 from the microphone 4 and determines an actual measured noise level (i.e., performs a real-time measurement). Noise management application 18 determines whether to adjust the sound masking noise output from the loudspeaker 2 utilizing both the actual measured noise parameter and the predicted future noise parameter. For example, noise management application 18 determines a magnitude or duration of deviation between the actual measured noise parameter and the predicted future noise parameter (i.e., identifies the accuracy of the predicted future noise parameter). If necessary, noise management application 18 adjusts the current output level. Noise management application 18 may respectively weight the actual measured noise parameter and the predicted future noise parameter based on the magnitude or duration of deviation. For example, if the magnitude of deviation is high, the real-time measured noise level is given 100% weight and the predicted future noise level given 0% weight in adjusting the current output level. Conversely, if the magnitude of deviation is zero or low, the predicted noise level is given 100% weight. Intermediate deviations result in a 50/50, 60/40, etc., weighting as desired.

FIG. 5 illustrates a microphone data record 500 generated and utilized by noise management application 18 in one example. Noise management application 18 generates and stores a microphone data record 500 for each individual microphone 4 in the open space 100. Microphone data record 500 may be a table identified by the microphone unique ID 502 (e.g., a serial number) and include the microphone location 504. Data record 500 includes the date 506, time 508, predicted noise level 510, and actual measured noise level 512 for the microphone unique ID 502. In addition to predicted noise levels 510 and actual measured noise levels 512, any gathered or measured parameter derived from microphone output data may be stored. For each microphone unique ID 502, the predicted noise level 510 and actual measured noise level 512 at periodic time intervals (e.g., every 250 ms to 1 second) is generated and measured, respectively, by and for use by noise management application 18 as described herein. Data in one or more data fields in the table may be obtained using a database and lookup mechanism.

In one example embodiment, noise management application 18 utilizes a prediction model as follows. First, noise management application 18 determines the general distraction pattern detected by each microphone 4. This is treated as a problem of curve fitting with non-linear regression on segmented data and performed using a machine learning model, using the historic microphone 4 data as training samples. The resulting best fit curve becomes the predicted distraction curve (PDC) for each microphone 4.

Next, using the predicted distraction curves of all microphones 4 in the open space 100, the predicted adaptation pattern is computed for the open space 100. For example, the same process is used as in a reactive adaptation process whereby there is a set of predicted output levels for the entire space for a given set of predicted distractions in the entire space. However, the process is not constrained. Meaning, it is allowed to adjust the output levels instantaneously to the distractions at any given point in time. This results in unconstrained individual predicted adaptation curves (PAC) for each speaker 2 in the open space 100.

Next, the unconstrained adaptation curves are smoothed to ensure the rate of change does not exceed the configured comfort level for the space. This is done by starting the ramp earlier in time to reach the target (or almost the target) without exceeding the configured ramp rate. An example representation is:

$$\frac{L_{target} - L_{current}}{T_{target} - T_{current}} \leq \text{ramprate},$$

where L is in dB, T is in seconds, and ramprate is in dB/sec.

In operation, these predicted adaptation curves obtained above are initially given a 100% weight and proactively adjust the loudspeaker 2 levels in the space 100. Such a proactive adjustment causes each loudspeaker 2 to reach the target level when the predicted distraction is expected to occur.

Simultaneously, the actual real-time distraction levels are also continuously monitored. The predictive adaptation continues in a proactive manner as long as the actual distractions match the predicted distractions. However, if the actual distraction levels deviate, then the proactive adjustment is suspended and the reactive adjustment is allowed to take over.

This is done in a progressive manner depending on the magnitude and duration of the deviation. An example representation is $$L = \propto * L\text{pred} + (1 - \propto) * L\text{act}$$

where $\propto$ is progressively decreased to shift the weight such that Lact contribution to the final value increases as long as the deviation exists and until it reaches 100%. When it reaches 100%, the system effectively operates in a reactive mode. The proactive adjustment is resumed when the deviation ceases. The occupancy and distraction patterns may change over time in the same space. Therefore, as new microphone 4 data is received, the prediction model is continuously updated.

Figure 6:
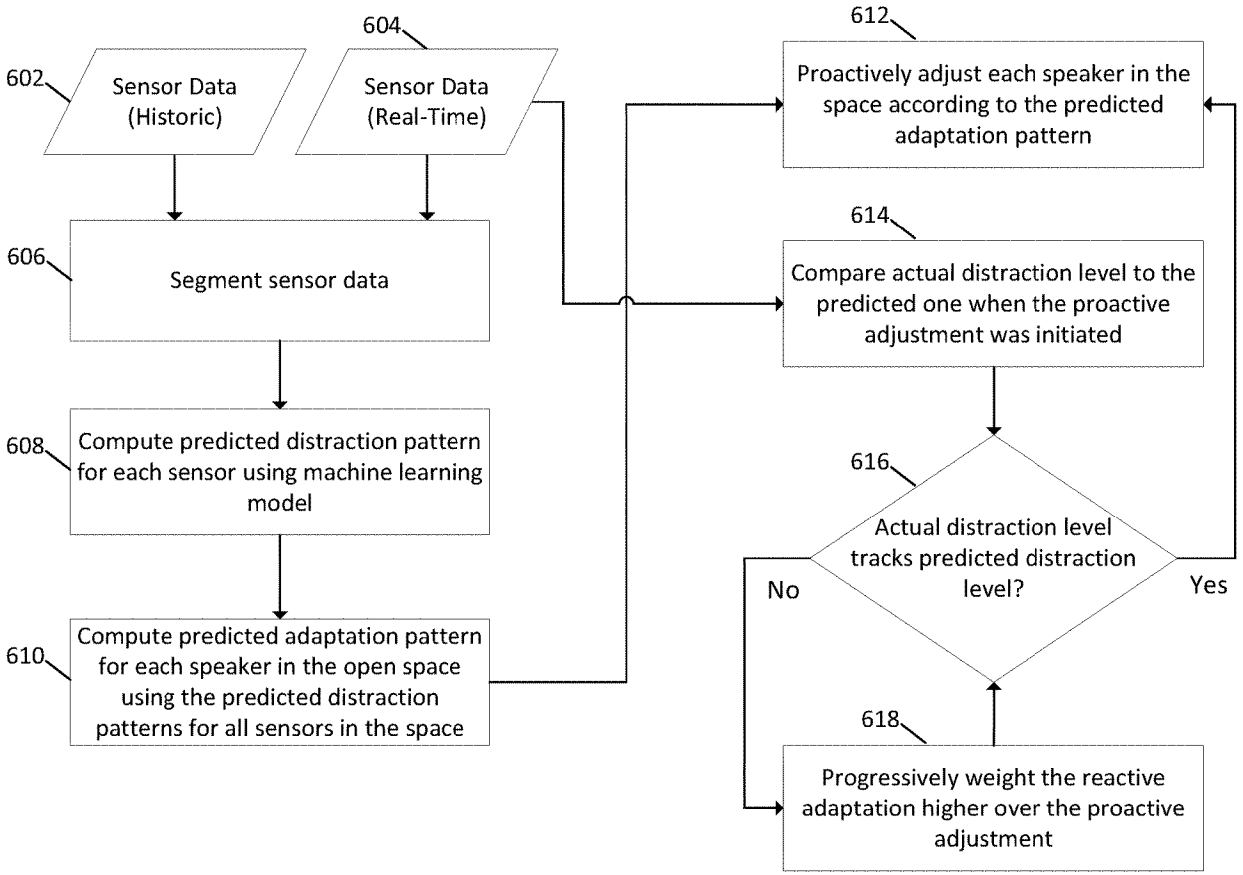
FIG. 6 illustrates an example sound masking sequence and operational flow.

FIG. 6 illustrates an example sound masking sequence and operational flow. At input block 602, sensor data (Historic) is input. At input block 604, sensor data (Real-Time) is input. At block 606, the sensor data is segmented by one or more different attributes. For example, the sensor data is segmented by day of the week, by month, or by individual microphone 4 (e.g., by microphone unique ID). At block 608, the predicted distraction pattern for each sensor is computed using a machine learning model. For example, supervised learning with non-linear regression is used. At block 610, the predicted adaptation pattern for each speaker in the open space is computed using the predicted distraction patterns for all sensors in the space. At block 612, each loudspeaker in the space is proactively adjusted according to the predicted adaptation pattern.

Block 614 receives sensor data (Real-Time) from block 604. At block 614, the actual distraction level is compared to the predicted one when the proactive adjustment was initiated. At decision block 616, it is determined whether the actual distraction level tracks the predicted distraction level. If Yes at decision block 816, the process returns to block 812. If No at decision block 816, at block 618, the reactive adaptation higher is progressively weighted over the proactive adjustment. Following block 618, the process returns to decision block 616.

Figure 9A:
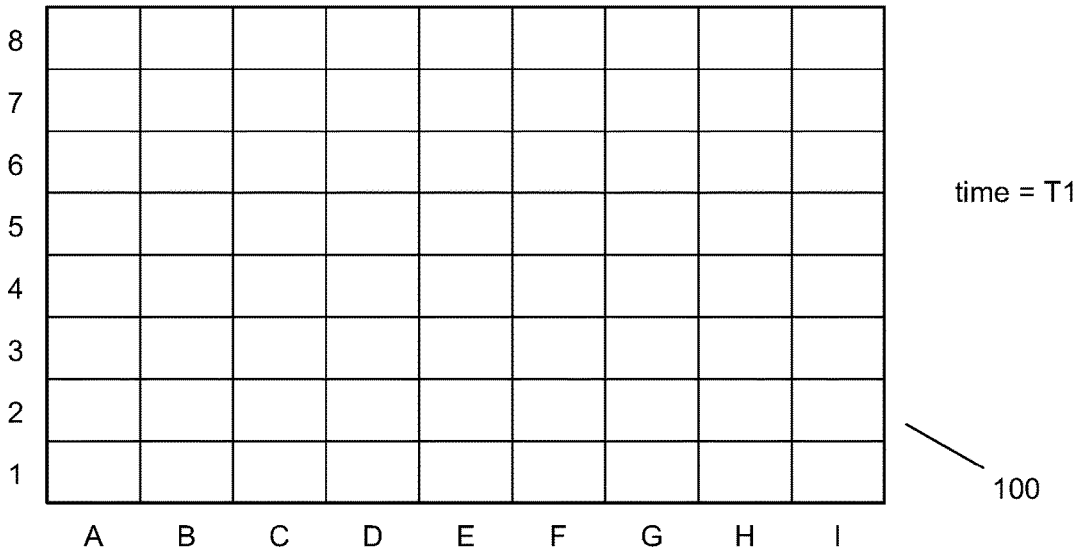
FIGS. 9A-9C illustrate ramping of the volume of the sound masking noise in localized areas of an open space prior to a predicted time of a predicted distraction.
Figure 9B:
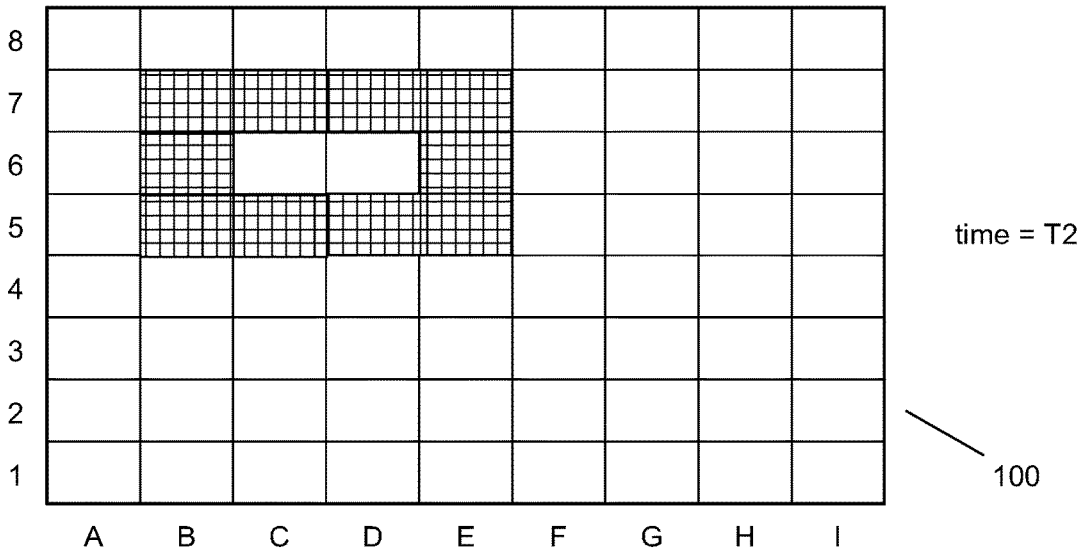
Figure 9C:
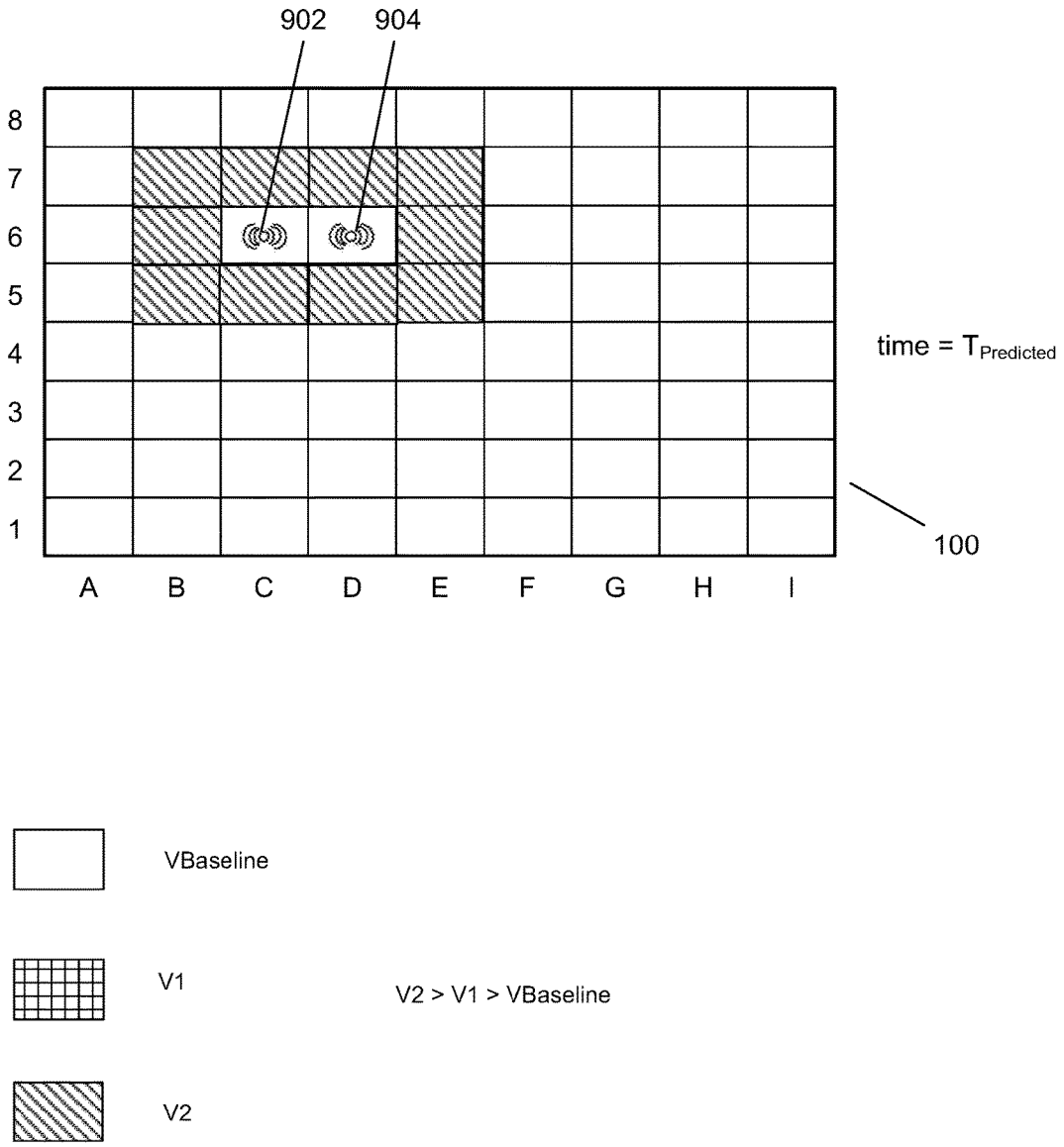

FIGS. 9A-9C are "heat maps" of the volume level (V) of the output of sound masking noise in localized areas of the open space 100 (microphones 4 and loudspeakers 2 are not shown for clarity) in one example. FIGS. 9A-9C illustrate ramping of the volume of the sound masking noise prior to a predicted future time ($T_{PREDICTED}$) of a predicted distraction 902 at location C6 and predicted distraction 904 at location D6 to achieve an optimal masking level (V2).

FIG. 9A illustrates open space 100 at a time T1, where time T1 is prior to time $T_{PREDICTED}$. In this example, at time T1, the output of the sound masking noise is at a volume V=VBaseline prior to the start of any ramping due to the predicted distraction.

FIG. 9B illustrates open space 100 at a time T2, where time T2 is after time T1, but still prior to time $T_{PREDICTED}$. At time T2, noise management application 18 has started the ramping process to increase the volume from VBaseline to ultimately reach optimal masking level V2. In this example, at time T2, the output of the sound masking noise is at a volume V=V1 at locations B5-E5, B6, E6, and B7-E7 immediately adjacent the locations C6 and D6 of the predicted distraction, where VBaseline<V1<V2.

FIG. 9C illustrates open space 100 at time $T_{PREDICTED}$. At time $T_{PREDICTED}$, noise management application 18 has completed the ramping process so that that the volume of the sound masking noise is optimal masking level V2 to mask predicted distraction 902 and 904 (e.g., noise sources 902 and 904), now currently present at time $T_{PREDICTED}$.

It should be noted that the exact locations at which the volume is increased to V2 (and previously to V1 in FIG. 9B) responsive to predicted noise sources 902 and 904 at locations C6 and D6 will vary based on the particular implementation and processes used. Furthermore, noise management application 18 may create a gradient where the volume level of the sound masking noise is decreased as the distance from the predicted noise sources 902 and 904 increases. Noise management application 18 may also account for specific noise transmission characteristics within open space 100, such as those resulting from physical structures within open space 100.

Finally, at locations further from predicted noise sources 902 and 904, such as locations B4, F5, etc., noise management application 18 does not adjust the output level of the sound masking noise from VBaseline. In this example, noise management application 18 has determined that the predicted noise sources 902 and 904 will not be detected at these locations. Advantageously, persons in these locations are not unnecessarily subjected to increased sound masking noise levels. Further discussion regarding the control of sound masking signal output at loudspeakers in response to detected noise sources can be found in the commonly assigned and co-pending U.S. patent application Ser. No. 15/615,733 entitled "Intelligent Dynamic Soundscape Adaptation", which was filed on Jun. 6, 2017, and which is hereby incorporated into this disclosure by reference.

Figure 3:
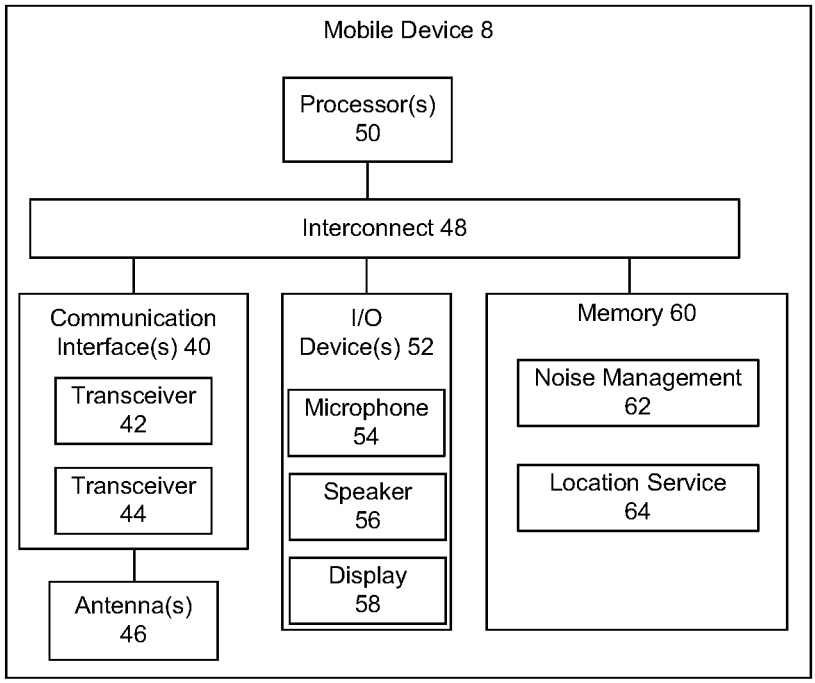
FIG. 3 illustrates a simplified block diagram of the mobile device shown in FIG. 1.

FIG. 3 illustrates a simplified block diagram of the mobile device 8 shown in FIG. 1. Mobile device 8 includes input/output (I/O) device(s) 52 configured to interface with the user, including a microphone 54 operable to receive a user voice input, ambient sound, or other audio. I/O device(s) 52 include a speaker 56, and a display device 58. I/O device(s) 52 may also include additional input devices, such as a keyboard, touch screen, etc., and additional output devices. In some embodiments, I/O device(s) 52 may include one or more of a liquid crystal display (LCD), an alphanumeric input device, such as a keyboard, and/or a cursor control device.

The mobile device 8 includes a processor 50 configured to execute code stored in a memory 60. Processor 50 executes a noise management application 62 and a location service module 64 to perform functions described herein. Although shown as separate applications, noise management application 62 and location service module 64 may be integrated into a single application.

Noise management application 62 gathers external data 20 for transmission to server 16. In one example, such gathered external data 20 includes measured noise levels at microphone 54 or other microphone derived data.

In one example, mobile device 8 utilizes location service module 64 to determine the present location of mobile device 8 for reporting to server 16 as external data 20. In one example, mobile device 8 is a mobile device utilizing the Android operating system. The location service module 64 utilizes location services offered by the Android device (GPS, WiFi, and cellular network) to determine and log the location of the mobile device 8. In further examples, one or more of GPS, WiFi, or cellular network may be utilized to determine location. The GPS may be capable of determining the location of mobile device 8 to within a few inches. In further examples, external data 20 may include other data accessible on or gathered by mobile device 8.

While only a single processor 50 is shown, mobile device 8 may include multiple processors and/or co-processors, or one or more processors having multiple cores. The processor 50 and memory 60 may be provided on a single application-specific integrated circuit, or the processor 50 and the memory 60 may be provided in separate integrated circuits or other circuits configured to provide functionality for executing program instructions and storing program instructions and other data, respectively. Memory 60 also may be used to store temporary variables or other intermediate information during execution of instructions by processor 50.

Memory 60 may include both volatile and non-volatile memory such as random access memory (RAM) and read-only memory (ROM). Device event data for mobile device 8 may be stored in memory 60, including noise level measurements and other microphone-derived data and location data for mobile device 8. For example, this data may include time and date data, and location data for each noise level measurement.

Mobile device 8 includes communication interface(s) 40, one or more of which may utilize antenna(s) 46. The communications interface(s) 40 may also include other processing means, such as a digital signal processor and local oscillators. Communication interface(s) 40 include a transceiver 42 and a transceiver 44. In one example, communications interface(s) 40 include one or more short-range wireless communications subsystems which provide communication between mobile device 8 and different systems or devices. For example, transceiver 44 may be a short-range wireless communication subsystem operable to communicate with a headset using a personal area network or local area network. The short-range communications subsystem may include an infrared device and associated circuit components for short-range communication, a near field communications (NFC) subsystem, a Bluetooth subsystem including a transceiver, or an IEEE 802.11 (WiFi) subsystem in various non-limiting examples.

In one example, transceiver 42 is a long range wireless communications subsystem, such as a cellular communications subsystem. Transceiver 42 may provide wireless communications using, for example, Time Division, Multiple Access (TDMA) protocols, Global System for Mobile Communications (GSM) protocols, Code Division, Multiple Access (CDMA) protocols, and/or any other type of wireless communications protocol.

Interconnect 48 may communicate information between the various components of mobile device 8. Instructions may be provided to memory 60 from a storage device, such as a magnetic device, read-only memory, via a remote connection (e.g., over a network via communication interface(s) 40) that may be either wireless or wired providing access to one or more electronically accessible media. In alternative examples, hard-wired circuitry may be used in place of or in combination with software instructions, and execution of sequences of instructions is not limited to any specific combination of hardware circuitry and software instructions.

Mobile device 8 may include operating system code and specific applications code, which may be stored in non-volatile memory. For example the code may include drivers for the mobile device 8 and code for managing the drivers and a protocol stack for communicating with the communications interface(s) 40 which may include a receiver and a transmitter and is connected to antenna(s) 46.

Figure 7:
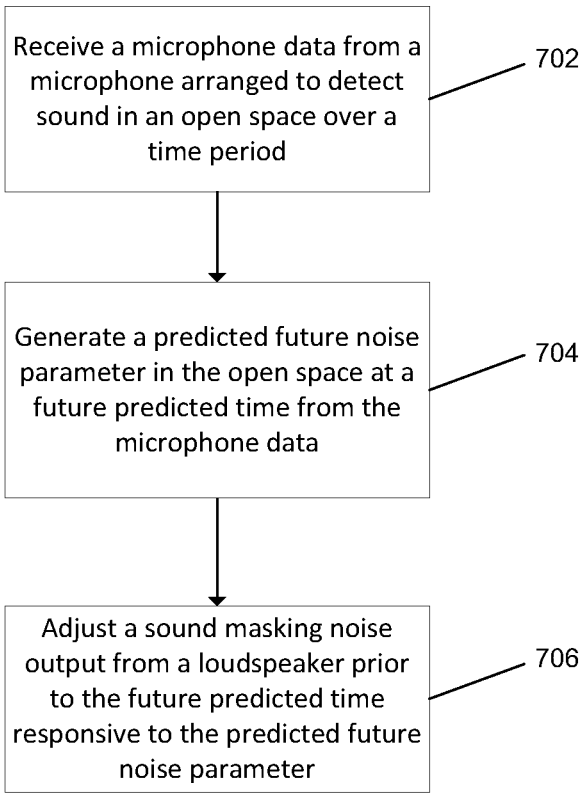
FIG. 7 is a flow diagram illustrating open space sound masking in one example.
Figure 8:
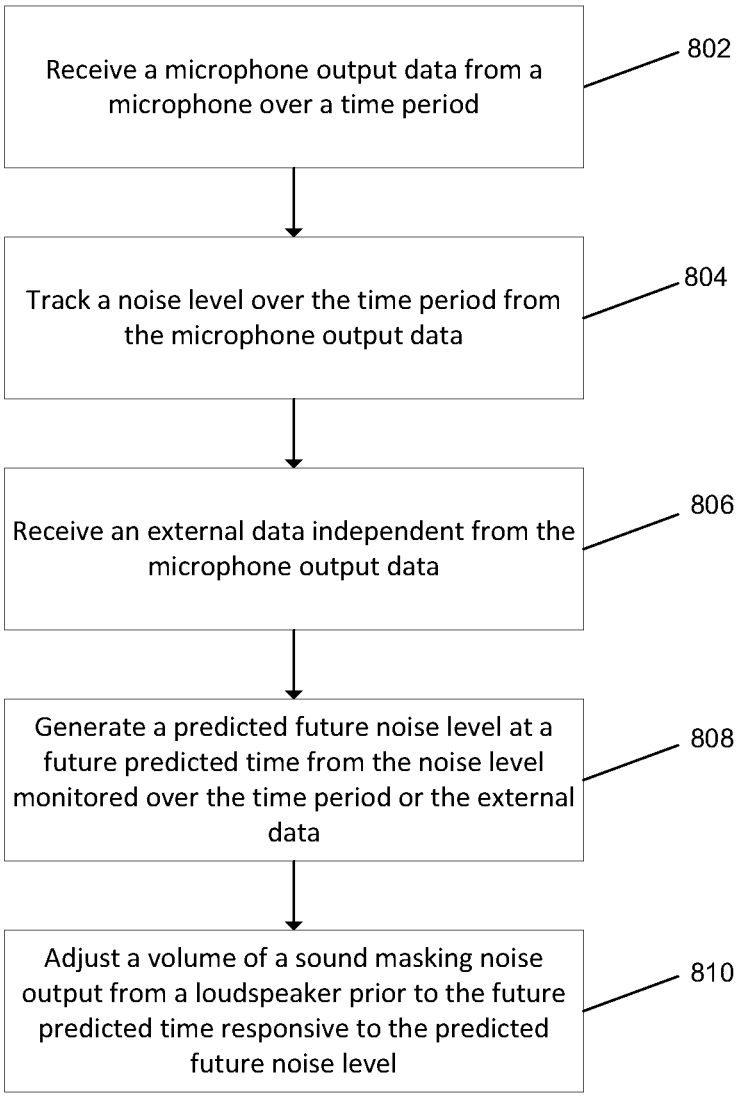
FIG. 8 is a flow diagram illustrating open space sound masking in a further example.

In various embodiments, the techniques of FIGS. 6-8 may be implemented as sequences of instructions executed by one or more electronic systems. FIG. 7 is a flow diagram illustrating open space sound masking in one example. For example, the process illustrated may be implemented by the system shown in FIG. 1.

At block 702, microphone data is received from a microphone arranged to detect sound in an open space over a time period. In one example, the microphone data is received on a continuous basis (i.e., 24 hours a day, 7 days a week), and the time period is a moving time period, such as the 7 days immediately prior to the current date and time.

For example, the microphone data may include noise level measurements, frequency distribution data, or voice activity detection data determined from sound detected at the one or more microphones. Furthermore, in addition to or in alternative to, the microphone data may include the sound itself (e.g., a stream of digital audio data). In one example, the microphone is one of a plurality of microphones in an open space, where there is a loudspeaker located in a same geographic sub-unit of the open space as the microphone.

External data may also be received, where the external data is utilized in generating the predicted future noise parameter at the predicted future time. For example, the external data is received from a data source over a communications network. The external data may be any type of data, and includes data from weather, traffic, and calendar sources. External data may be sensor data from sensors at a mobile device or other external data source.

At block 704, one or more predicted future noise parameters (e.g., a predicted future noise level) in the open space at a predicted future time is generated from the microphone data. For example, the predicted future noise parameter is a noise level or noise frequency. In one example, the noise level in the open space is tracked to generate the predicted future noise parameter at the predicted future time.

The microphone data (e.g., noise level measurements) is associated with a date and time data, which is utilized to in generating the predicted future noise parameter at the predicted future time. Distraction incidents are identified from the microphone data, which are also used in the prediction process. The distraction incidents are associated with their date and time of occurrence, microphone identifier for the microphone providing the microphone data, and location identifier. For example, the distraction incident is a noise level above a pre-determined threshold or a voice activity detection. In one example, a distraction pattern from two or more distraction incidents is identified from the microphone data.

At block 706, a sound masking noise output from a loudspeaker is adjusted prior to the predicted future time responsive to the predicted future noise parameter. For example, a volume level of the sound masking noise is adjusted and/or sound masking noise type or frequency is adjusted. In one example, the sound masking noise output is ramped up or down from a current volume level to reach a pre-determined target volume level at the predicted future time. Microphone location data may be utilized to select a co-located loudspeaker at which to adjust the sound masking noise.

In one example, the sound masking process incorporates real-time monitoring (i.e., upon the arrival of the predicted future time) in conjunction with the prediction processes. For example, upon the arrival of the predicted future time, additional microphone data is received and an actual measured noise parameter (e.g., noise level) is determined. The sound masking noise output from the loudspeaker is adjusted utilizing both the actual measured noise level and the predicted future noise level.

A magnitude or duration of deviation between the actual measured noise level and the predicted future noise level is determined to identify whether and/or by how much to adjust the sound masking noise level. A relative weighting of the actual measured noise level and the predicted future noise level may be determined based on the magnitude or duration of deviation. For example, if the magnitude of deviation is high, only the actual measured noise level is utilized to determine the output level of the sound masking noise (i.e., the actual measured noise level is given 100% weight and the predicted future noise level given 0% weight). Conversely, if the magnitude of deviation is low, only the predicted noise level is utilized to determine the output level of the sound masking noise (i.e., the predicted noise level is given 100% weight). Intermediate deviations result in a 50/50, 60/40, etc., weighting as desired.

FIG. 8 is a flow diagram illustrating open space sound masking in a further example. For example, the process illustrated may be implemented by the system shown in FIG. 1. At block 802, a microphone output data is received from a microphone over a time period. For example, the microphone is one of a plurality of microphones in an open space and a loudspeaker is located in a same geographic sub-unit of the open space as the microphone. A location data for a microphone is utilized to determine the loudspeaker in the same geographic sub-unit at which to adjust the sound masking noise.

At block 804, a noise level is tracked over the time period from the microphone output data. At block 806, an external data independent from the microphone output data is received. For example, the external data is received from a data source over a communications network.

At block 808, a predicted future noise level at a predicted future time is generated from the noise level monitored over the time period or the external data. In one example, date and time data associated with the microphone output data is utilized to generate the predicted future noise level at the predicted future time.

At block 810, a volume of a sound masking noise output from a loudspeaker is adjusted prior to the predicted future time responsive to the predicted future noise level. The sound masking noise output is ramped from a current volume level to reach a pre-determined target volume level at the predicted future time.

In one example, the sound masking process incorporates real-time monitoring (i.e., upon the arrival of the predicted future time) in conjunction with the prediction processes. Upon arrival of the predicted future time, microphone output data is received and a noise level is measured. An accuracy of the predicted future noise level is identified from the measured noise level. For example, the deviation of the measured noise level from the predicted future noise level is determined. The volume of the sound masking noise output from the loudspeaker is adjusted at the predicted future time responsive to the accuracy of the predicted future noise level. In one example, the volume of the sound masking noise output is determined from a weighting of the measured noise level and the predicted future noise level.

FIG. 10 illustrates a system block diagram of a server 16 suitable for executing software application programs that implement the methods and processes described herein in one example. The architecture and configuration of the server 16 shown and described herein are merely illustrative and other computer system architectures and configurations may also be utilized.

The exemplary server 16 includes a display 1003, a keyboard 1009, and a mouse 1011, one or more drives to read a computer readable storage medium, a system memory 1053, and a hard drive 1055 which can be utilized to store and/or retrieve software programs incorporating computer codes that implement the methods and processes described herein and/or data for use with the software programs, for example. For example, the computer readable storage medium may be a CD readable by a corresponding CD-ROM or CD-RW drive 1013 or a flash memory readable by a corresponding flash memory drive. Computer readable medium typically refers to any data storage device that can store data readable by a computer system. Examples of computer readable storage media include magnetic media such as hard disks, floppy disks, and magnetic tape, optical media such as CD-ROM disks, magneto-optical media such as optical disks, and specially configured hardware devices such as application-specific integrated circuits (ASICs), programmable logic devices (PLDs), and ROM and RAM devices.

The server 16 includes various subsystems such as a microprocessor 1051 (also referred to as a CPU or central processing unit), system memory 1053, fixed storage 1055 (such as a hard drive), removable storage 1057 (such as a flash memory drive), display adapter 1059, sound card 1061, transducers 1063 (such as loudspeakers and microphones), network interface 1065, and/or printer/fax/scanner interface 1067. The server 16 also includes a system bus 1069. However, the specific buses shown are merely illustrative of any interconnection scheme serving to link the various subsystems. For example, a local bus can be utilized to connect the central processor to the system memory and display adapter. Methods and processes described herein may be executed solely upon CPU 1051 and/or may be performed across a network such as the Internet, intranet networks, or LANs (local area networks) in conjunction with a remote CPU that shares a portion of the processing.

While the exemplary embodiments of the present invention are described and illustrated herein, it will be appreciated that they are merely illustrative and that modifications can be made to these embodiments without departing from the spirit and scope of the invention. Acts described herein may be computer readable and executable instructions that can be implemented by one or more processors and stored on a computer readable memory or articles. The computer readable and executable instructions may include, for example, application programs, program modules, routines and subroutines, a thread of execution, and the like. In some instances, not all acts may be required to be implemented in a methodology described herein.

Terms such as "component", "module", and "system" are intended to encompass software, hardware, or a combination of software and hardware. For example, a system or component may be a process, a process executing on a processor, or a processor. Furthermore, a functionality, component or system may be localized on a single device or distributed across several devices. The described subject matter may be implemented as an apparatus, a method, or article of manufacture using standard programming or engineering techniques to produce software, firmware, hardware, or any combination thereof to control one or more computing devices.

Thus, the scope of the invention is intended to be defined only in terms of the following claims as may be amended, with each claim being expressly incorporated into this Description of Specific Embodiments as an embodiment of the invention.

What is claimed is:

1. A method comprising:

receiving a microphone data from a microphone arranged to detect sound in an open space over a time period;

generating a predicted future noise parameter in the open space at a predicted future time from the microphone data;

adjusting a sound masking noise output from a loudspeaker prior to the predicted future time responsive to the predicted future noise parameter;

receiving a second microphone data from the microphone at the predicted future time;

determining an actual measured noise parameter from the second microphone data at the predicted future time; and adjusting the sound masking noise output from the loudspeaker utilizing both the actual measured noise parameter and the predicted future noise parameter.

2. The method of claim 1, wherein the predicted future noise parameter comprises a noise level.

3. The method of claim 1, wherein adjusting the sound masking noise output comprises adjusting a volume level of the sound masking noise.

4. The method of claim 1, wherein adjusting the sound masking noise output comprises adjusting a sound masking noise type or frequency.

5. The method of claim 1, wherein generating the predicted future noise parameter at the predicted future time from the microphone data comprises tracking a noise level in the open space during the time period.

6. The method of claim 1, wherein the microphone data comprises noise level measurements, frequency distribution data, or voice activity detection data determined from sound detected at the microphone.

7. The method of claim 1, wherein the microphone is one of a plurality of microphones in the open space and the loudspeaker is one of a plurality of loudspeakers in the open space.

8. The method of claim 7, wherein the loudspeaker is located in a same geographic sub-unit of the open space as the microphone.

9. The method of claim 1, wherein adjusting the sound masking noise output from the loudspeaker prior to the predicted future time comprises ramping up or down at a configured ramp rate the sound masking noise output from a current volume level to reach a pre-determined target volume level at the predicted future time.

10. The method of claim 1, wherein adjusting the sound masking noise output from the loudspeaker utilizing both the actual measured noise parameter and the predicted future noise parameter comprises determining a magnitude or duration of deviation between the actual measured noise parameter and the predicted future noise parameter.

11. The method of claim 1, further comprising receiving an external data in addition to the microphone data, wherein the external data is utilized in generating the predicted future noise parameter at the predicted future time.

12. The method of claim 1, wherein generating the predicted future noise parameter comprises identifying a distraction incident from the microphone data.

13. A method comprising:

receiving a microphone data from a microphone arranged to detect sound in an open space over a time period;

generating a predicted future noise parameter in the open space at a predicted future time from the microphone data, wherein generating the predicted future noise parameter comprises identifying a distraction incident from the microphone data, wherein the distraction incident is associated with its date and time of occurrence, microphone identifier for the microphone providing the microphone data, and location identifier; and adjusting a sound masking noise output from a loudspeaker prior to the predicted future time responsive to the predicted future noise parameter.

14. The method of claim 1, wherein generating the predicted future noise parameter comprises identifying a distraction pattern from two or more distraction incidents identified from the microphone data.

15. A method comprising:

receiving a microphone output data from a microphone over a time period;

tracking a noise level over the time period from the microphone output data;

receiving an external data independent from the microphone output data;

generating a predicted future noise level at a predicted future time from the noise level monitored over the time period or the external data;

adjusting a volume of a sound masking noise output from a loudspeaker prior to the predicted future time responsive to the predicted future noise level;

receiving a second microphone output data from the microphone at the predicted future time;

determining a measured noise level from the second microphone output data at the predicted future time;

identifying an accuracy of the predicted future noise level from the measured noise level; and adjusting the volume of the sound masking noise output from the loudspeaker at the predicted future time responsive to the accuracy of the predicted future noise level.

16. The method of claim 15, wherein the microphone is one of a plurality of microphones in an open space and the loudspeaker is one of a plurality of loudspeakers in the open space.

17. The method of claim 16, wherein the loudspeaker is located in a same geographic sub-unit of the open space as the microphone.

18. The method of claim 15, wherein adjusting the volume of the sound masking noise output comprises ramping the sound masking noise output from a current volume level to reach a pre-determined target volume level at the predicted future time.

19. The method of claim 15, wherein the volume of the sound masking noise output from the loudspeaker at the predicted future time is determined from a weighting of the measured noise level and the predicted future noise level.

20. The method of claim 15, further comprising associating the microphone output data with a date and time data, wherein generating the predicted future noise level at the predicted future time utilizes the date and time data.

21. The method of claim 15, further comprising receiving a location data associated with the microphone, the location data utilized in adjusting the sound masking noise output at the one or more loudspeakers.

22. The method of claim 15, wherein the external data is received from a data source over a communications network.

23. A system comprising:

a plurality of microphones to be disposed in an open space;

a plurality of loudspeakers to be disposed in the open space; and one or more computing devices comprising:

one or more communication interfaces configured to receive a plurality of microphone data from the plurality of microphones and configured to transmit sound masking noise for output at the plurality of loudspeakers;

a processor; and one or more memories storing one or more application programs comprising instructions executable by the processor to perform operations comprising:

receiving a microphone data from a microphone arranged to detect sound in the open space over a time period, the microphone included in the plurality of microphones;

generating a predicted future noise parameter in the open space at a predicted future time from the microphone data;

adjusting a sound masking noise output from a loudspeaker prior to the predicted future time responsive to the predicted future noise parameter, the loudspeaker one of the plurality of loudspeakers;

receiving a second microphone data from the microphone at the predicted future time;

determining a measured noise level from the second microphone data at the predicted future time;

identifying an accuracy of the predicted future noise parameter from the measured noise level; and adjusting the sound masking noise output from the loudspeaker at the predicted future time responsive to the accuracy of the predicted future noise parameter.

24. The system of claim 23, wherein the one or more memories store a microphone location data for each microphone in the plurality of microphones and a loudspeaker location data for each loudspeaker in the plurality of loudspeakers.

25. The system of claim 23, wherein generating the predicted future noise parameter at the predicted future time from the microphone data comprises tracking a noise level in the open space during the time period.

26. The system of claim 23, wherein the operations further comprise receiving an external data in addition to the microphone data, wherein the external data is utilized in generating the predicted future noise parameter at the predicted future time.

27. The system of claim 23, wherein the microphone and the loudspeaker are correlated with each other based on a same geographic location.

* * * * *